US010347135B2

(12) United States Patent
Suzuki et al.

(10) Patent No.: US 10,347,135 B2
(45) Date of Patent: Jul. 9, 2019

(54) SHIP TRACK DATA DISPLAY METHOD, SHIP TRACK DATA DISPLAY DEVICE, AND COMPUTER-READABLE RECORDING MEDIUM

(71) Applicant: FUJITSU LIMITED, Kawasaki-shi, Kanagawa (JP)

(72) Inventors: Hiroko Suzuki, Kawasaki (JP); Isamu Watanabe, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 87 days.

(21) Appl. No.: 15/464,950

(22) Filed: Mar. 21, 2017

(65) Prior Publication Data

US 2017/0309190 A1 Oct. 26, 2017

(30) Foreign Application Priority Data

Apr. 22, 2016 (JP) ..... 2016-086077

(51) Int. Cl.
*G08G 3/02* (2006.01)
*B63B 49/00* (2006.01)

(52) U.S. Cl.
CPC ..... *G08G 3/02* (2013.01); *B63B 49/00* (2013.01)

(58) Field of Classification Search
CPC ..... G08G 3/02; B63B 49/00
See application file for complete search history.

(56) References Cited

U.S. PATENT DOCUMENTS 7,417,583 B2 * 8/2008 Wood ..... G01S 13/42 342/123
7,830,275 B2 * 11/2010 Hiraoka ..... B63B 49/00 340/984
8,836,570 B2 * 9/2014 Ponsford ..... G01S 13/9307 340/984
9,892,645 B2 * 2/2018 Morishita ..... G08G 5/0026
2006/0290562 A1 * 12/2006 Ehresman ..... G08G 3/02 342/41
2007/0188734 A1 8/2007 Waquet

FOREIGN PATENT DOCUMENTS

JP 2008-514483 5/2008

* cited by examiner

*Primary Examiner* — Todd M Melton
(74) *Attorney, Agent, or Firm* — Fujitsu Patent Center

(57) ABSTRACT

A non-transitory computer-readable recording medium stores a ship track data display program that causes a computer to execute a process including: first extracting particular ship track data for a set of particular ships with a relative distance therebetween being within a predetermined range, from ship track data for a plurality of ships; second extracting a place where a distance between ship tracks thereof is at a local minimum, from the particular ship track data; and associatively displaying, for the place, point data of a ship that previously arrives at the place, in the set of particular ships, and point data of another ship at a point of time when the ship that previously arrives at the place arrives at the place.

8 Claims, 11 Drawing Sheets

SHIP TRACK DATA DISPLAY METHOD, SHIP TRACK DATA DISPLAY DEVICE, AND COMPUTER-READABLE RECORDING MEDIUM

CROSS-REFERENCE TO RELATED APPLICATION

This application is based upon and claims the benefit of priority of the prior Japanese Patent Application No. 2016-086077, filed on Apr. 22, 2016, the entire contents of which are incorporated herein by reference.

FIELD

The embodiments discussed herein are related to a computer-readable recording medium, a ship track data display method, and a ship track data display device.

BACKGROUND

Recently, a technique has generally been known that creates a ship track of a ship based on data obtained from an Automatic Identification System (AIS) or the like. Also, a technique has generally been known that connects positions of ships at an identical point of time with a line segment by using a plurality of created ship tracks, so that a positional relationship between the ships is visualized. Such a technique is used so as to connect positions of ships at an identical point of time with a line segment, and thereby, a case where a risk of collision is estimated to be high, such as a case where ships cause abnormal closeness therebetween or a case where avoidance behavior is made to avoid collision therebetween, can be indicated. For example, a result of such visualization can be utilized for further testing or determination as to whether a risky case is caused, and extraction of such a case.

Japanese National Publication of International Patent Application No. 2008-514483

However, it may be impossible for a related technique to readily extract a case where a risk of collision between ships is estimated to be high. For extraction of a case where it is estimated that a risk of collision is high and avoidance behavior is made, for example, in a related technique, as positional information of each ship is acquired at a small time interval and respective positions of ships at each point of time are connected with a line segment, many line segments are displayed at a small interval, and hence, it may be impossible to readily determine whether a ship makes avoidance behavior thereof.

Herein, a method can be considered that connects respective positions of ships with a line segment at a large time interval. However, as respective positions of ships are connected with a line segment at a large time interval, for example, positions of ships at a point of time when it is estimated that the ships are closest to one another and a risk of collision therebetween is high may be unconnected with a line segment. Hence, it may be impossible to readily determine whether a ship makes avoidance behavior thereof.

Thus, in a related technique, even in a case where a positional relationship between ships is visualized, work to extract a risky case where a ship makes avoidance behavior thereof is cumbersome and it may be impossible to readily extract such a case where a ship makes avoidance behavior thereof.

In a first idea, a ship track data display program causes a computer to execute a step of extracting particular ship track data for a set of particular ships with a relative distance therebetween being within a predetermined range, from ship track data for a plurality of ships. The ship track data display program causes a computer to execute a step of extracting a place where a distance between ship tracks thereof is at a local minimum, from the particular ship track data. The ship track data display program causes a computer to execute a step of associatively displaying, for the extracted place, point data of a ship that previously arrives at the extracted place, in the set of particular ships, and point data of another ship at a point of time when the ship that previously arrives at the extracted place arrives thereat.

SUMMARY

According to an aspect of the embodiments, a non-transitory computer-readable recording medium stores a ship track data display program that causes a computer to execute a process including: first extracting particular ship track data for a set of particular ships with a relative distance therebetween being within a predetermined range, from ship track data for a plurality of ships; second extracting a place where a distance between ship tracks thereof is at a local minimum, from the particular ship track data; and associatively displaying, for the place, point data of a ship that previously arrives at the place, in the set of particular ships, and point data of another ship at a point of time when the ship that previously arrives at the place arrives at the place.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Preferred embodiments will be explained with reference to accompanying drawings. This invention is not limited by these embodiments. It is possible to combine respective embodiments appropriately as long as process contents thereof are consistent with one another. Hereinafter, a case where the invention is applied to a support system that supports sailing of a ship will be described as an example.

System Configuration

Figure 1:
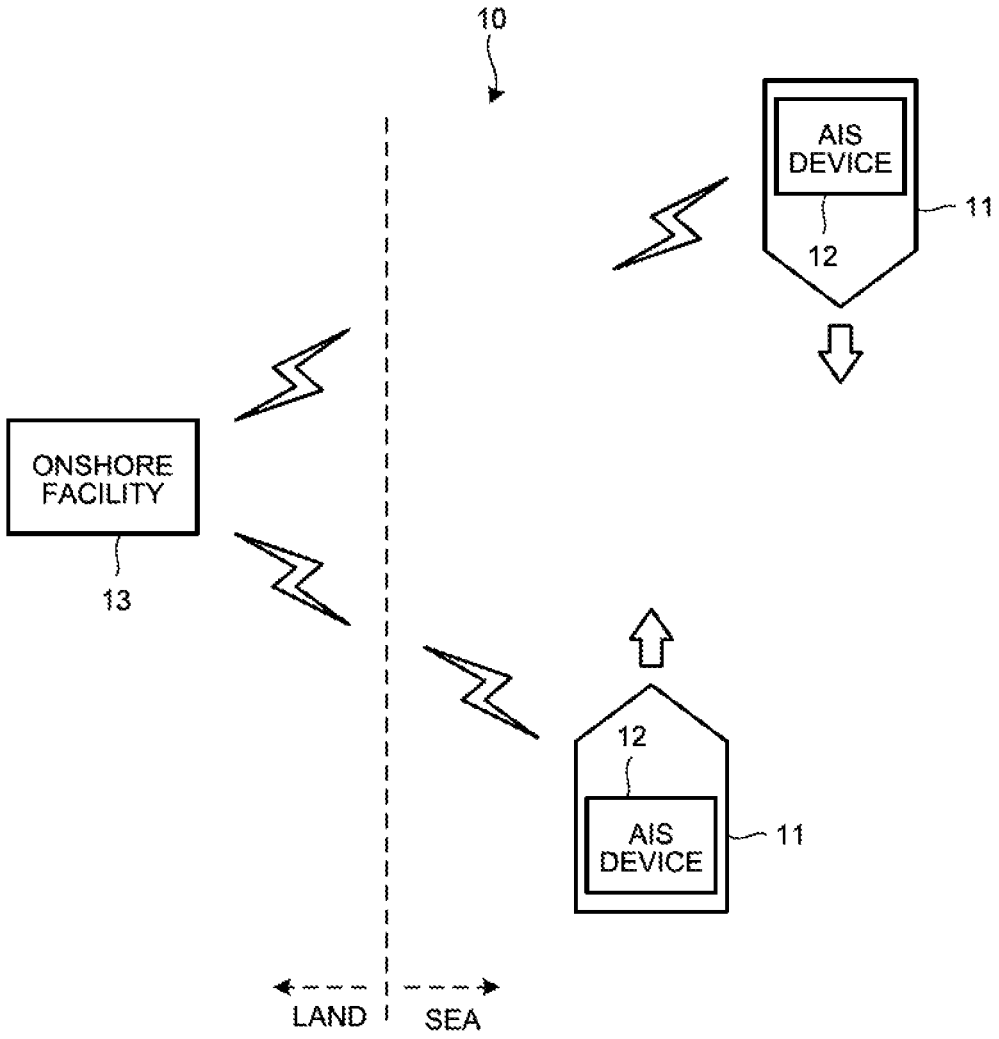
FIG. 1 is a diagram illustrating an example of a general configuration of a support system.

First, an example of a support system 10 according to a first embodiment will be described. FIG. 1 is a diagram illustrating an example of a general configuration of a support system. The support system 10 is a system that supports sailing of a ship.

FIG. 1 illustrates two ships 11 and an onshore facility 13. The ship 11 is mounted with an AIS device 12. For example, a particular ship is obligated to mount the AIS device 12 according to a law or the like. Such a particular ship corresponds to any ship of 300 gross tons or more that engages in an international voyage, any passenger ship that engages in an international voyage, or any ship of 500 gross tons or more that does not engage in an international voyage. The AIS device 12 may also be mounted on a ship other than such a particular ship.

The AIS device 12 periodically transmits AIS information that includes a variety of information on the ship 11 mounted therewith through wireless communication. AIS information includes, for example, information such as a position represented by latitude and longitude, a ship name, a point of time, a direction of a bow of the ship 11, an identification code of the ship 11 such as a Maritime Mobile Service Identity (MMSI) number, or a length or a width of the ship 11. AIS information is receivable by the other ship 11 or the onshore facility 13. The other ship 11 or the onshore facility 13 can catch a variety of information such as a position of the ship 11, a ship name, a point of time, a direction of a bow of the ship 11, an identification code of the ship 11, or a length or a width of the ship 11, based on received AIS information.

The onshore facility 13 is, for example, a facility that executes control of sailing of each ship 11, such as a vessel traffic service center or a port traffic control office that has a role in monitoring, or providing information to, a ship on a sea. The onshore facility 13 catches a position of each ship 11 based on AIS information received from each ship 11, information detected by a radar, or the like, and provides a variety of information on sea traffic to each ship 11.

Configuration of Ship Track Data Display Device

Figure 2:
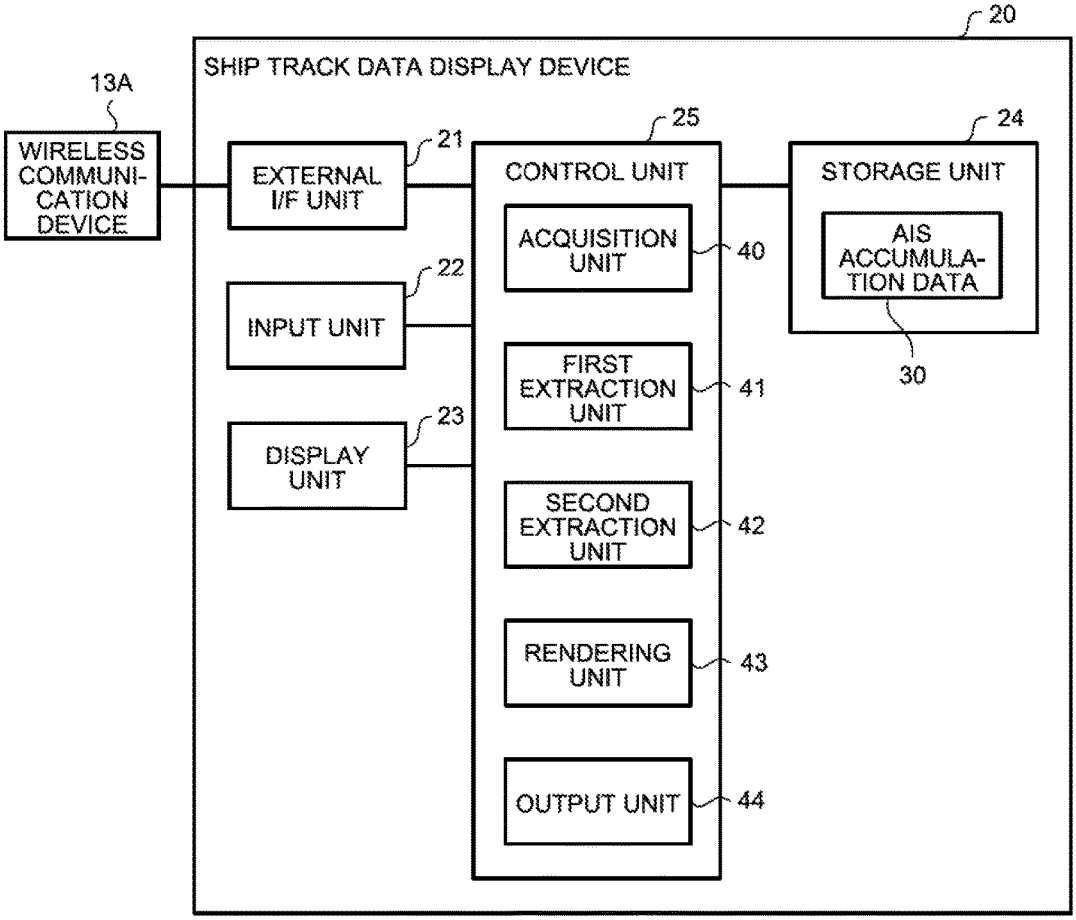
FIG. 2 is a diagram illustrating a general configuration of a ship track data display device.

Next, a configuration of a ship track data display device 20 according to the first embodiment will be described. FIG. 2 is a diagram illustrating a general configuration of the ship track data display device 20. For example, the ship track data display device 20 is provided for the onshore facility 13. For example, the ship track data display device 20 is a computer such as a server computer. The ship track data display device 20 may be provided as a single computer or may be provided as a plurality of computers. In the present embodiment, a case where the ship track data display device 20 is a single computer will be described as an example.

Recently, a case where a risk of collision is estimated to be high, such as a case where ships cause abnormal closeness therebetween or a case where avoidance behavior is made to avoid collision therebetween, is extracted by using AIS information for a safety operation of a ship, then a factor or situation such as abnormal closeness is statistically modeled, and a risk of collision is calculated or predicted by using an obtained model. In the present embodiment, a case where the ship track data display device 20 displays a case where it is estimated that a ship 11 has a high risk of collision and makes avoidance behavior thereof will be described as an example.

The ship track data display device 20 includes an external interface (I/F) unit 21, an input unit 22, a display unit 23, a storage unit 24, and a control unit 25.

The external I/F unit 21 is, for example, an interface that transmits to or receives from another device, a variety of information. The external I/F unit 21 is capable of wireless communication with each ship 11 through a wireless communication device 13A such as an antenna provided for the onshore facility 13, and transmits to or receives from each ship 11, a variety of information. For example, the external I/F unit 21 receives AIS information from each ship 11 through the wireless communication device 13A.

The input unit 22 is an input device that inputs a variety of information. For the input unit 22, an input device is provided that accepts input of an operation, such as a mouse or a keyboard. The input unit 22 accepts input of a variety of information. For example, the input unit 22 accepts input of an operation for instructing starts of a variety of processes. The input unit 22 inputs operation information that indicates a content of an accepted operation to the control unit 25.

The display unit 23 is a display device that displays a variety of information. For the display unit 23, a display device such as a Liquid Crystal Display (LCD) or a Cathode Ray Tube (CRT) is provided. The display unit 23 displays a variety of information. For example, the display unit 23 displays a variety of screens such as an operation screen.

The storage unit 24 is a storage device such as a hard disk, a Solid State Drive (SSD), or an optical disk. The storage unit 24 may be a data rewritable semiconductor memory such as a Random Access Memory (RAM), a flash memory, or a Non-Volatile Static Random Access Memory (NVS-RAM).

The storage unit 24 stores an Operating System (OS) and a variety of programs that are executed by the control unit 25. For example, the storage unit 24 stores a program for executing a ship track data display process as described later. The storage unit 24 further stores a variety of data that are used for a program that is executed by the control unit 25. For example, the storage unit 24 stores AIS accumulation data 30.

The AIS accumulation data 30 are data provided by accumulating AIS information received from each ship 11.

The control unit 25 is a device that controls the ship track data display device 20. For the control unit 25, an electronic circuit such as a Central Processing Unit (CPU) or a Micro Processing Unit (MPU) or an integrated circuit such as an Application Specific Integrated Circuit (ASIC) or a Field Programmable Gate Array (FPGA) can be employed. The control unit 25 includes an internal memory for storing a program that defines steps of a variety of processes, and control data, and thereby, executes the variety of processes. The control unit 25 operates a variety of programs, and thereby, functions as a variety of processing units. For example, the control unit 25 includes an acquisition unit 40, a first extraction unit 41, a second extraction unit 42, a rendering unit 43, and an output unit 44.

The acquisition unit 40 stores AIS information received from each ship 11 through the wireless communication device 13A as the AIS accumulation data 30. Although a case where AIS information is received by the ship track data display device 20 will be described in the present embodiment, such AIS information may be stored in an external storage device such as a "storage" device. In such a case, the acquisition unit 40 acquires AIS information of each ship 11 from an external storage device.

The first extraction unit 41 obtains, for each ship 11, ship track data that indicates a ship track of the ship 11, from the AIS accumulation data 30. Herein, such a ship track is a trajectory of a position of the ship 11. For example, the first extraction unit 41 obtains point data that includes positional information that indicates a position of the ship 11 at a predetermined interval, with reference to the AIS accumulation data 30. Such a predetermined interval is, for example, 1 second, and is not limited thereto. The first extraction unit 41 obtains point data at each point of time from the AIS accumulation data 30, and obtains ship track data from the obtained point data.

In a case where periods of time for transmitting AIS information from the respective ships 11 are different from one another, the first extraction unit 41 may obtain, for each ship 11, point data at each point of time, by interpolation, from a position or a velocity in the AIS information. For example, the first extraction unit 41 calculates, for each ship 11, point data at each point of time, or every 1 second, by interpolation.

The first extraction unit 41 extracts, as particular ship track data, ship track data of a set of particular ships with a relative distance that is a practical distance between the ships 11 being within a predetermined range, from data of a plurality of ship tracks. For example, the first extraction unit 41 extracts, as particular ship track data, point data at a first predetermined period of time before point data with a relative distance being within a predetermined range to point data at a second predetermined period of time after the point data with a relative distance being within a predetermined range. Such a predetermined range is, for example, 200 [m], and is not limited thereto. Such a predetermined range may be changeable externally. For example, the display unit 23 may be caused to display a screen for setting a predetermined range that is changeable by input from the input unit 22. Such a first predetermined period of time is, for example, 10 minutes, and is not limited thereto. Such a second predetermined period of time is, for example, 8 minutes, and is not limited thereto. Such a first predetermined period of time and a second predetermined period of time may be changeable externally. For example, the display unit 23 may be caused to display a screen for setting a first predetermined period of time and a screen for setting a second predetermined period of time that are changeable by input from the input unit 22. For example, in a case where point data with a relative distance being 200 [m] are provided, the first extraction unit 41 extracts, as particular ship track data, point data at 10 minutes before a point of time when a relative distance is 200 [m] to point data at 8 minutes after the point of time when a relative distance is 200 [m]. Hereinafter, the ships 11 that are included in a set of particular ships will be described as a ship 11A and a ship 11B.

The second extraction unit 42 extracts a place where a distance between ship tracks is at a local minimum (that will be referred to as a "local minimum point", below), from particular ship track data. For example, the second extraction unit 42 calculates a distance from each of point data of a ship track of the ship 11A to point data of a ship track of the ship 11B that are closest thereto, and extracts a place where a distance between ship tracks of the ship 11A and the ship 11B is at a local minimum.

For example, the second extraction unit 42 calculates a distance between point data Ai of the ship 11A and each of point data Bj of the ship 11B, at a point of time ti. The second extraction unit 42 sets a distance that is smallest among calculated distances, as a distance between ship tracks at a point of time ti. The second extraction unit 42 sets distances between ship tracks at all points of time in particular ship track data. The second extraction unit 42 extracts a local minimum point based on the set distances between ship tracks.

Figure 3:
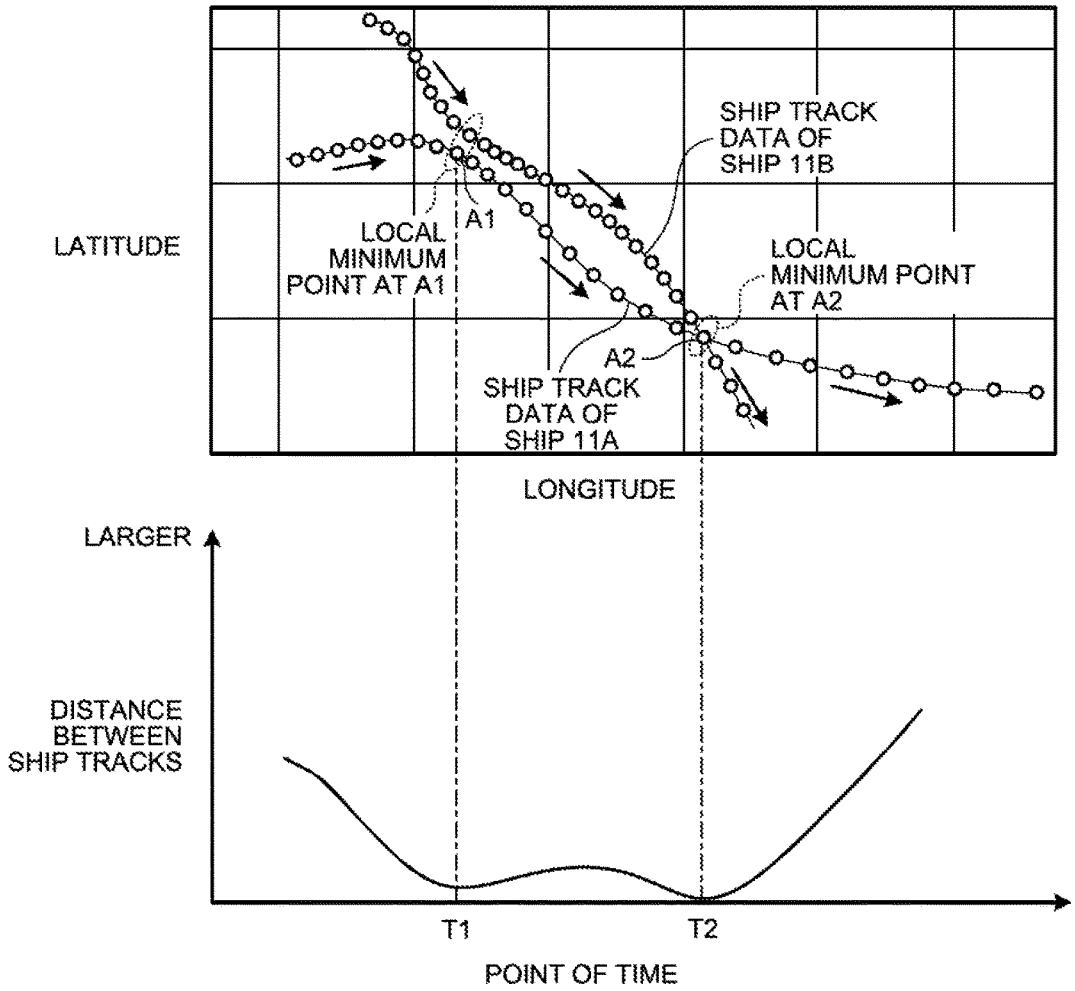
FIG. 3 is a diagram illustrating an example of particular ship track data and a distance between ship tracks.

FIG. 3 is a diagram illustrating an example of particular ship track data and a distance between ship tracks. FIG. 3 illustrates ship track data of a ship 11A and ship track data of a ship 11B as particular ship track data. A distance between ship tracks as illustrated in FIG. 3 is a distance between ship tracks with reference to point data of the ship 11A. In FIG. 3, a part of point data is omitted for illustration. According to ship track data as illustrated in FIG. 3, a distance between ship tracks of the ship 11A and the ship 11B is once decreased and is at a local minimum at point data A1 of the ship 11A at a point of time T1. Subsequently, a distance between ship tracks of the ship 11A and the ship 11B is once increased and subsequently decreased. Then, ship track data of the ship 11A and ship track data of the ship 11B cross at point data A2 of the ship 11A at a point of time T2, so that a distance between ship tracks of the ship 11A and the ship 11B is at a local minimum. That is, local minimum points are extracted at the point of time T1 and the point of time T2 from ship track data as illustrated in FIG. 3. According to ship track data and a distance between ship tracks as illustrated in FIG. 3, it is also possible to read that the ship 11A and the ship 11B cause abnormal closeness therebetween at the point of time T1 and the point of time T2.

Figure 4:
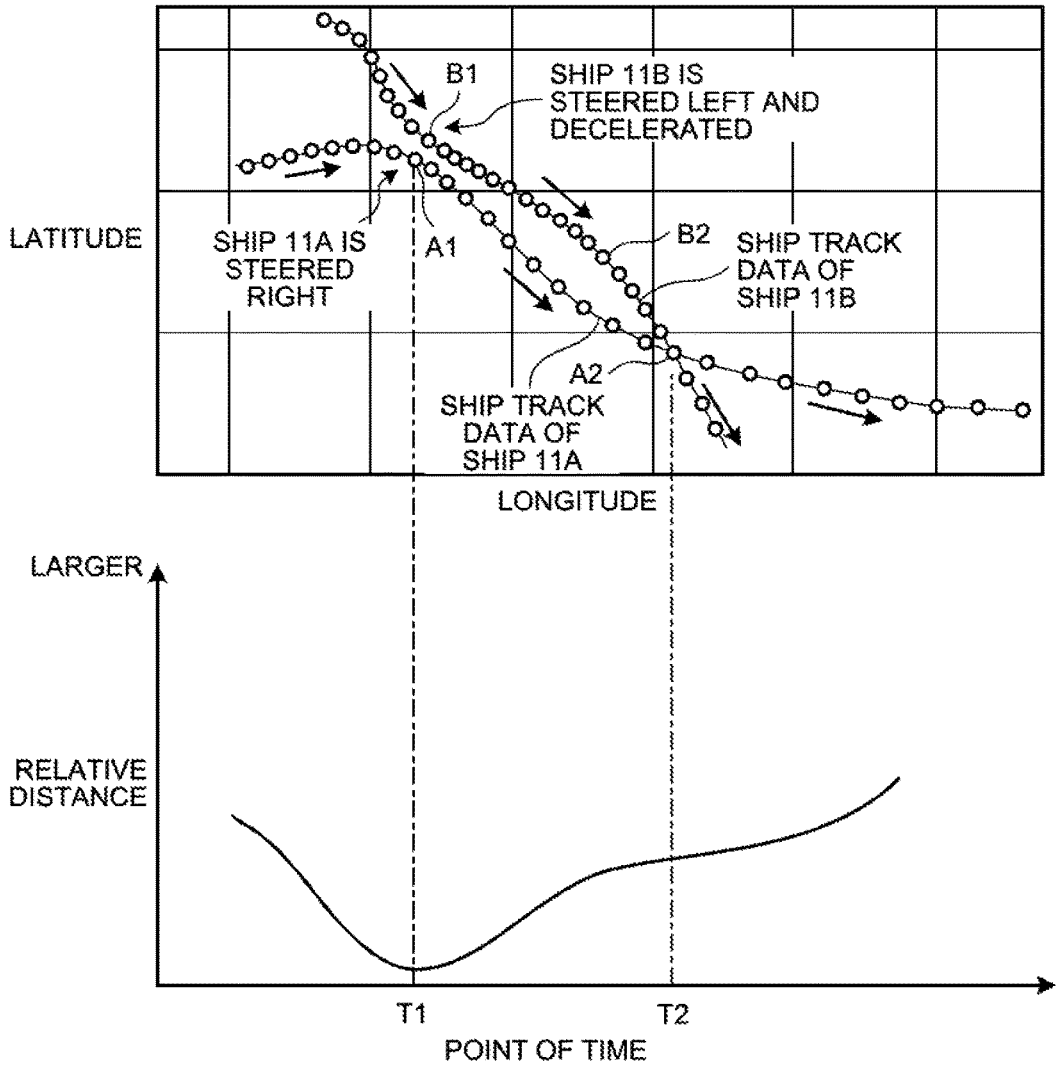
FIG. 4 is a diagram illustrating an example of particular ship track data and a relative distance.

FIG. 4 is a diagram illustrating an example of particular ship track data and a relative distance. FIG. 4 illustrates ship track data of a ship 11A and ship track data of a ship 11B as particular ship data, similar to those of FIG. 3. In a vicinity of a local minimum point at a point of time T1 as illustrated in FIG. 3, a relative distance between the ship 11A and the ship 11B is small as illustrated in FIG. 4, so that the ship 11A and the ship 11B cause abnormal closeness therebetween. Hence, the ship 11A is steered right and the ship 11B is steered left and decelerated, so that the ship 11A and the ship 11B practically make avoidance behavior thereof. Thereby, the ship 11A and the ship 11B are closest to one another at the point data A1 and the point data B1 at the point of time T1, so that a relative distance therebetween is at a minimum.

Ship track data of the ship 11A and ship track data of the ship 11B cross at a local minimum point at the point of time T2 as illustrated in FIG. 3. However, the ship 11B is decelerated after the point of time T1. Hence, as illustrated in FIG. 4, the ship 11B is located at the point data B2 and does not arrive at a local minimum point, at a point of time T2 when the ship 11A arrives at a local minimum point. Therefore, as illustrated in FIG. 4, a relative distance is large in a vicinity of a local minimum point at the point of time T2, so that the ship 11A and the ship 11B do not cause abnormal closeness therebetween. Hence, the ship 11A and the ship 11B do not practically make avoidance behavior thereof.

Thus, in a case where determination as to whether the ship 11A and the ship 11B make avoidance behavior thereof is executed based on ship track data thereof or a distance between ship tracks thereof, it may be difficult to determine whether the ship 11A and the ship 11B practically make avoidance behavior thereof. Hence, it may be difficult to extract a risky case where the ship 11A and the ship 11B make avoidance behavior thereof.

In the present embodiment, the ship track data display device 20 associatively renders point data at a local minimum point as described below.

The rendering unit 43 extracts point data of the ship 11A and point data of the ship 11B at a local minimum point. The rendering unit 43 compares a point of time when the ship 11A arrives at a local minimum point and a point of time when the ship 11B arrives at the local minimum point, and determines a ship 11 that previously arrives at the local minimum point.

The rendering unit 43 extracts, at a point of time when a ship 11 previously arrives at a local minimum point, point data of the other ship 11. For example, the rendering unit 43 extracts point data of the ship 11B at the point of time T1 in a case where the ship 11A previously arrives at a local minimum point at the point of time T1.

The rendering unit 43 creates data that connect point data of the ship 11A and point data of the ship 11B with a line segment, at a point of time when a ship 11 previously arrives at a local minimum point.

In a case where a plurality of local minimum points are provided, the rendering unit 43 creates data that connect point data of the ship 11A and point data of the ship 11B with a line segment, at a point of time when a ship 11 previously arrives at each local minimum point.

The output unit 44 executes a variety of output. For example, the output unit 44 outputs data created in the rendering unit 43 to the display unit 23. Thereby, an image with point data of the ship 11A and point data of the ship 11B being connected with a line segment at a point of time when a ship 11 previously arrives at a local minimum point is displayed on the display unit 23. That is, an image with enhanced practical positions of the ship 11A and the ship 11B at a local minimum point is displayed on the display unit 23.

Figure 5:
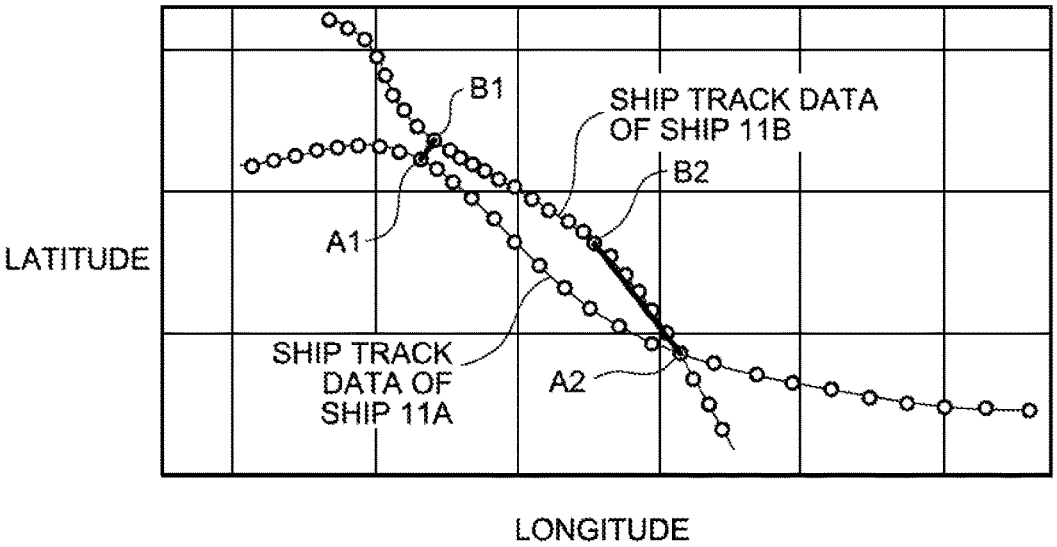
FIG. 5 is a diagram illustrating an example of an image that indicates practical positions of ships at a local minimum point.

FIG. 5 is a diagram illustrating an example of an image in the present embodiment that indicates a practical position of a ship 11 at a local minimum point. FIG. 5 illustrates a line segment that connects point data A1 of a ship 11A and point data B1 of a ship 11B at a point of time T1 in an example of particular ship track data as illustrated in FIG. 3. FIG. 5 also illustrates a line segment that connects point data A2 of the ship 11A and point data B2 of the ship 11B at a point of time T2 in the example of particular ship track data as illustrated in FIG. 3. A length of a line segment at each of the point of time T1 and the point of time T2 indicates a relative distance therebetween at the corresponding point of time. It can be found that a relative distance therebetween is small at the point of time T1 to provide a risky case where the ship 11A and the ship 11B make avoidance behavior thereof. On the other hand, it can be found that a relative distance therebetween is large at the point of time T2 not to provide a risky case where the ship 11A and the ship 11B make avoidance behavior thereof. In the present embodiment, the ship track data display device 20 extracts a local minimum point and causes the display unit 23 to display an image with point data of the ship 11A and point data of the ship 11B being associatively connected with a line segment, at the local minimum point. The ship track data display device 20 provides information that can readily be determined as to whether a risky case where the ship 11A and the ship 11B make avoidance behavior thereof is provided. Hence, whether a risky case where the ship 11A and the ship 11B make avoidance behavior thereof is provided can readily be determined.

Figure 6:
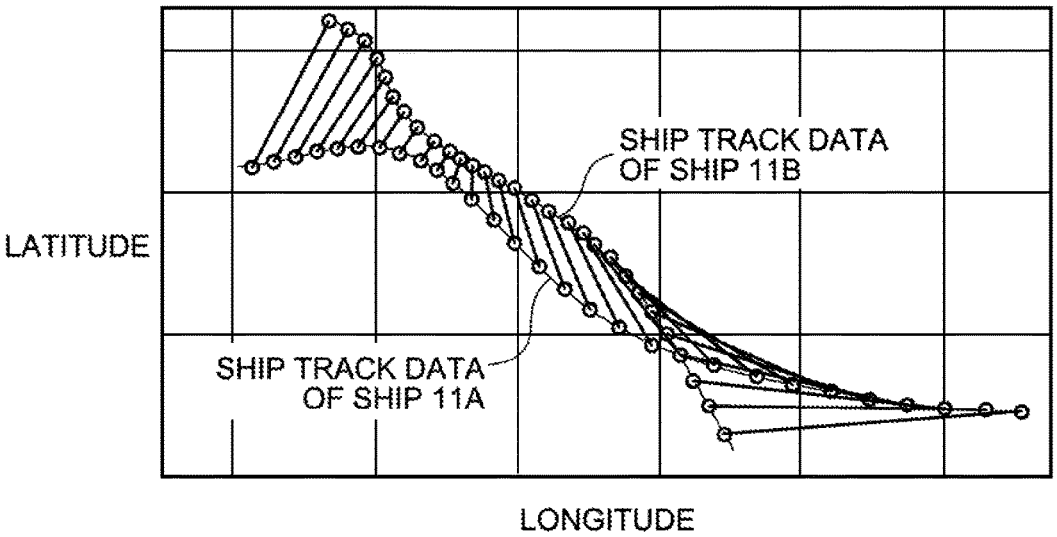
FIG. 6 is a diagram illustrating an example of a comparative example.

FIG. 6 is a diagram illustrating an example of a comparative example for the present embodiment. FIG. 6 illustrates, for any point of time, a line segment that connects point data of the ship 11A and point data of the ship 11B at an identical point of time in the example of particular ship track data as illustrated in FIG. 3. In FIG. 6, a part of point data is omitted for illustration. As point data of the ship 11A and point data of the ship 11B at any point of time are connected with a line segment, many line segments are displayed at a small interval. Hence, it may be impossible to readily determine whether a risky case where the ship 11A and the ship 11B make avoidance behavior thereof is provided.

Accordingly, it is considered that the number of line segments that connect point data of the ship 11A and point data of the ship 11B is reduced.

Figure 7:
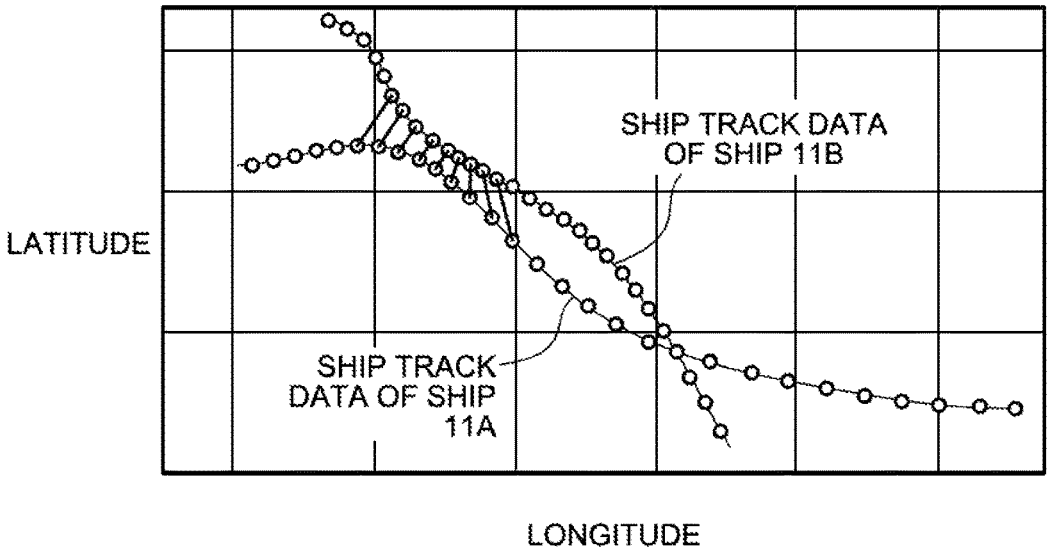
FIG. 7 is a diagram illustrating an example of a comparative example.

FIG. 7 is a diagram illustrating an example of a comparative example for the present embodiment. FIG. 7 illustrates a line segment that connects point data of a ship 11A and point data of a ship 11B, where a relative distance therebetween is within a predetermined range, in the example of particular ship track data as illustrated in FIG. 3. In such a comparative example, the number of line segments is reduced. However, a positional relationship between the ship 11A and the ship 11B at a place where ship track data thereof cross is unclear. Hence, it may be impossible to readily determine whether a risky case where the ship 11A and the ship 11B make avoidance behavior thereof is provided at a place where ship track data of the ship 11A and ship track data of the ship 11B cross.

Figure 8:
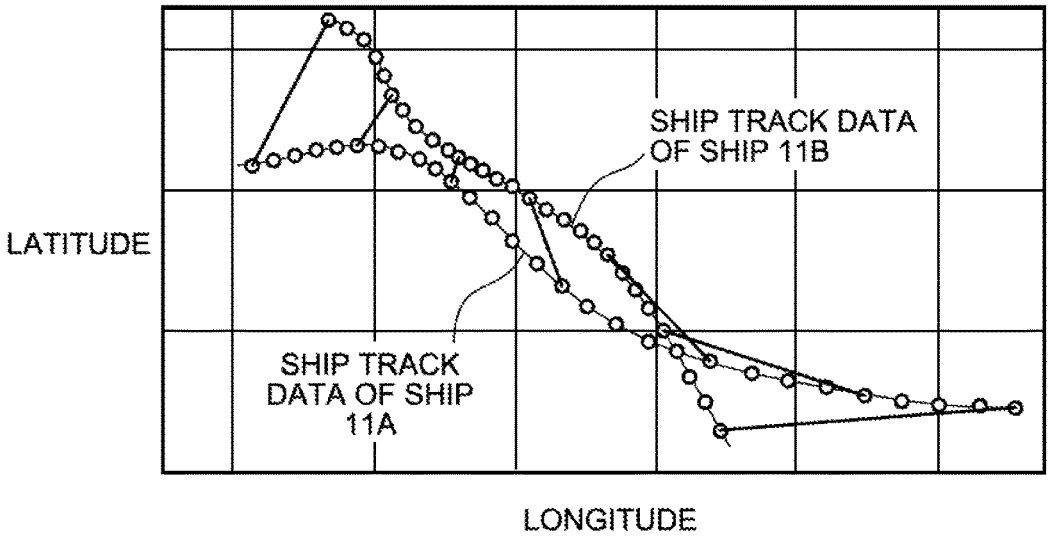
FIG. 8 is a diagram illustrating an example of a comparative example.

FIG. 8 is a diagram illustrating an example of a comparative example for the present embodiment. FIG. 8 illustrates, for each predetermined period of elapsed time, a line segment that connects point data of a ship 11A and point data of a ship 11B at an identical point of time, in the example of particular ship track data as illustrated in FIG. 3. Such a predetermine period of elapsed time is, for example, 3 minutes, and is not limited thereto. In such a comparative example, none of point data at a point of time when a local minimum point is provided may be connected with a line segment. Hence, it may be impossible to readily determine whether a risky case where the ship 11A and the ship 11B make avoidance behavior thereof is provided at a place where ship track data of the ship 11A and ship track data of the ship 11B cross.

Figure 9:
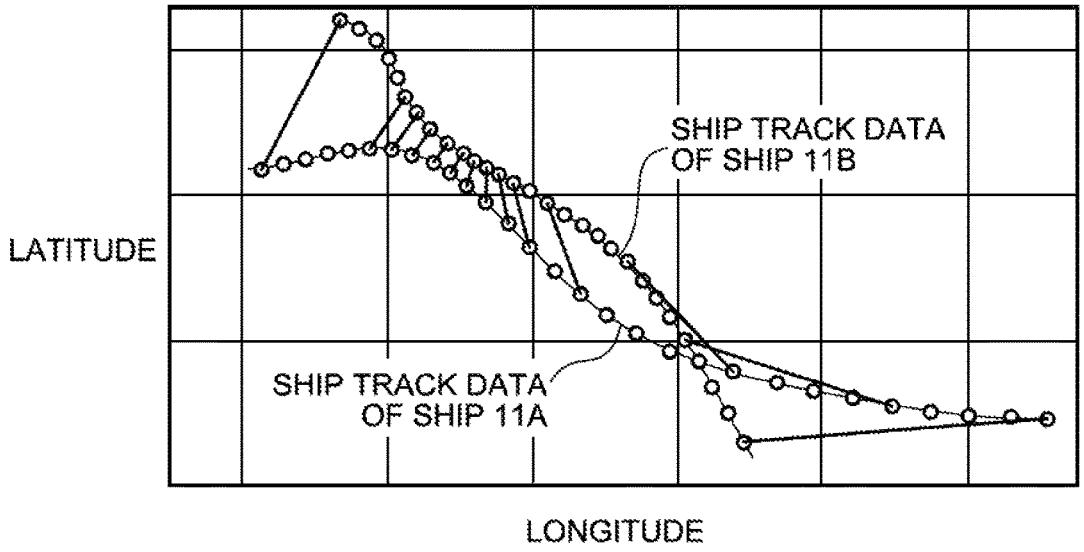
FIG. 9 is a diagram illustrating an example of a comparative example.

FIG. 9 is a diagram illustrating an example of a comparative example for the present embodiment. FIG. 9 illustrates a line segment that connects point data of a ship 11A and point data of a ship 11B with a relative distance therebetween being within a predetermined range, in the example of particular ship track data as illustrated in FIG. 3. FIG. 9 also illustrates, for each predetermined period of elapsed time, a line segment that connects point data of the ship 11A and point data of the ship 11B at an identical point of time, in the example of particular ship track data as illustrated in FIG. 3. Even in such a comparative example, none of point data at a point of time when a local minimum point is provided may be connected with a line segment. Hence, it may be impossible to readily determine whether a risky case where the ship 11A and the ship 11B make avoidance behavior thereof is provided at a place where ship track data of the ship 11A and ship track data of the ship 11B cross.

Against such comparative examples, the ship track data display device 20 in the present embodiment extracts a local minimum point, and displays a line segment that connects point data of a ship 11A and point data of a ship 11B at the local minimum point. Hence, whether a risky case where the ship 11A and the ship 11B make avoidance behavior thereof at a local minimum point is provided can readily be determined.

Flow of Process

Figure 10:
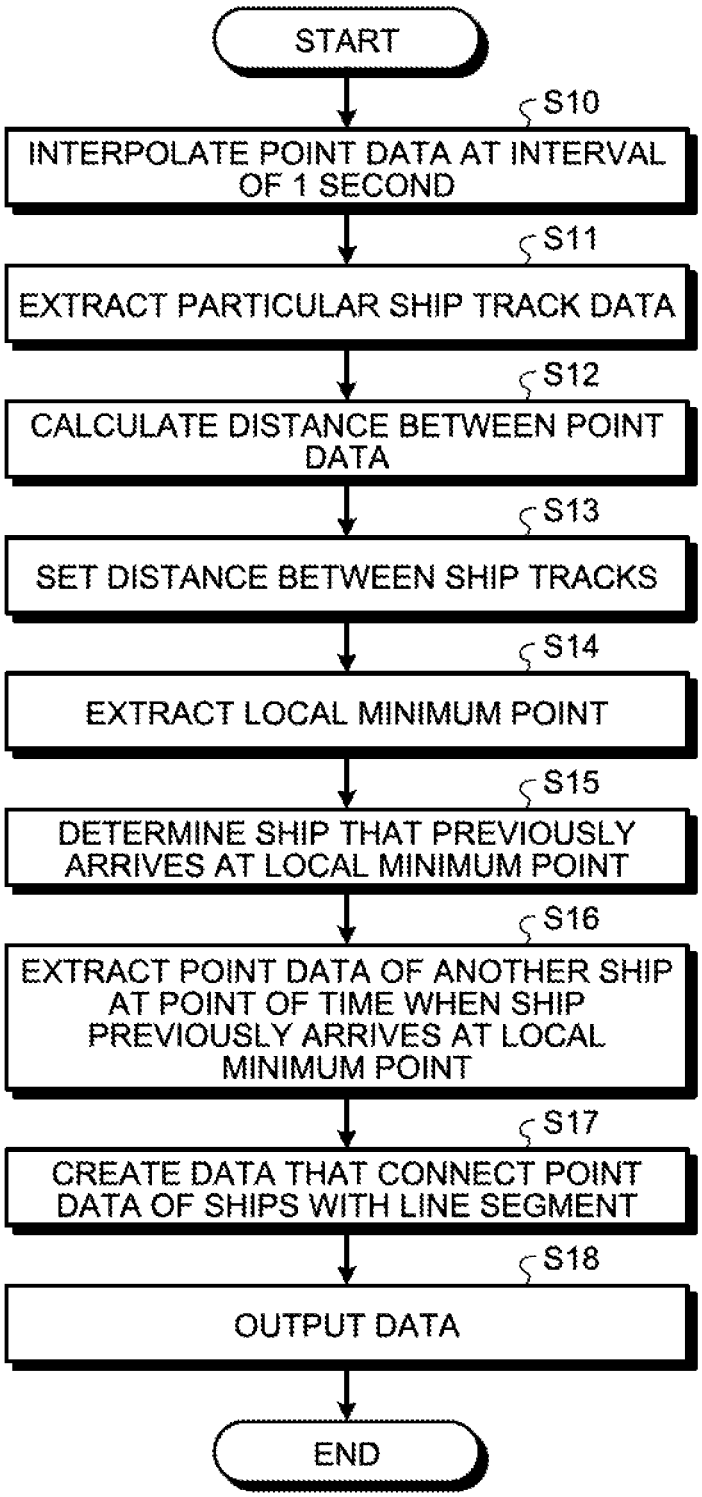
FIG. 10 is a flowchart illustrating an example of steps of a ship track data display process.

Next, a flow of a ship track data display process that is executed by the ship track data display device 20 according to the present embodiment will be described. FIG. 10 is a flowchart illustrating an example of steps of a ship track data display process. Such a display process is executed at predetermined timing, for example, timing when a predetermined operation for instructing a start of the process is accepted.

As illustrated in FIG. 10, the first extraction unit 41 calculates, for each ship 11, point data at each point of time, or every 1 second, by interpolation, from the AIS accumulation data 30 (S10). The first extraction unit 41 extracts, from a plurality of ship track data, particular ship track data for a set of particular ships with a relative distance therebetween being within a predetermined range (S11).

The second extraction unit 42 calculates a distance between point data of a ship 11A and point data of a ship 11B from the particular ship track data (S12). The second extraction unit 42 sets a minimum distance among the calculated distances, as a distance between ship tracks thereof (S13). The second extraction unit 42 extracts a local minimum point from the set distance between ship tracks (S14).

The rendering unit 43 determines a ship 11 that previously arrives at the local minimum point (S15). The rendering unit 43 extracts, at a point of time when the ship 11 previously arrives at the local minimum point, point data of the other ship 11 (S16). The rendering unit 43 creates data that connects point data of the ship 11A and point data of the ship 11B with a line segment, at a point of time when the ship 11 previously arrives at the local minimum point (S17).

The output unit 44 outputs the data created by the rendering unit 43 (S18) and ends the process. For example, the output unit 44 outputs, to the display unit 23, a still image with point data of ships 11 being connected with a line segment at a time when the ship 11 previously arrives at the local minimum point.

Advantageous Effect

The ship track data display device 20 according to the present embodiment extracts particular ship track data for a set of particular ships with a relative distance therebetween being within a predetermined range, from ship track data for a plurality of ships 11. The ship track data display device 20 extracts a local minimum point where a distance between ship tracks thereof is at a local minimum, from the particular ship track data. The ship track data display device 20 associatively displays, for the local minimum point, point data of a ship 11 that previously arrives at the local minimum point, in the set of particular ships, and point data of another ship 11 at a point of time when the ship 11 that previously arrives at the local minimum point arrives thereat. Thereby, the ship track data display device 20 can provide information capable of readily extracting a case where a risk of collision is estimated to be high, such as a case where ships 11 causes abnormal closeness therebetween or a case where avoidance behavior is made to avoid collision therebetween. Hence, such a case for ships 11 can readily be extracted.

Furthermore, the ship track data display device 20 according to the present embodiment associatively displays, for the local minimum point, point data of a ship 11 that previously arrives at the local minimum point, in the set of particular ships, and point data of another ship 11 at a point of time when the ship 11 that previously arrives at the local minimum point arrives thereat. Thereby, the ship track data display device 20 can associatively display point data where it is estimated that ships 11 causes abnormal closeness therebetween or makes avoidance behavior thereof, and a risk of collision therebetween is high, independently of sizes of the ships 11.

Furthermore, the ship track data display device 20 according to the present embodiment associatively displays, for the local minimum point, point data of a ship 11 that previously arrives at the local minimum point, in the set of particular ships, and point data of another ship 11 at a point of time when the ship 11 that previously arrives at the local minimum point arrives thereat. Thereby, the ship track data display device 20 displays positions of ships 11 at a point of time when a ship 11 previously arrives at a local minimum point, and hence, can represent a risk of collision between the ships 11 at the local minimum point with respect to time.

Furthermore, the ship track data display device 20 draws a line segment that connects the point data of a ship 11 that previously arrives at the local minimum point and the point data of another ship 11 at a point of time when the ship 11 that previously arrives at the local minimum point arrives thereat. Thereby, the ship track data display device 20 can emphatically display a place where a ship 11 has a possibility of making avoidance behavior thereof. Hence, a case where a risk of collision is estimated to be high, such as a case where ships 11 causes abnormal closeness therebetween or a case where avoidance behavior is made to avoid collision therebetween can readily be extracted.

Furthermore, the ship track data display device 20 extracts, as the particular ship track data, point data at a first predetermined period of time before that of point data with the relative distance being within the predetermined range to point data at a second predetermined period of time after that of the point data with the relative distance being within the predetermined range. Thereby, the ship track data display device 20 can reduce particular ship track data to be extracted, and can downsize a region to be displayed. Hence, the ship track data display device 20 can extend and display, for example, a vicinity of a local minimum point, than a case where a region to be displayed is large. Hence, a case where a risk of collision is estimated to be high, such as a case where ships 11 causes abnormal closeness therebetween or a case where avoidance behavior is made to avoid collision therebetween can readily be extracted.

Although the embodiment for a disclosed device has been described above, a disclosed technique may be implemented in a variety of different modes as well as the embodiment described above. Hereinafter, other embodiments that are included in the present invention will be described.

For example, although a case where a predetermined range is 200 [m] has been described as an example in the embodiment as described above, a disclosed device is not limited thereto. For example, a predetermined range may be set depending on a size of a ship 11 for extracting a case where avoidance behavior thereof is made. A small ship 11 has a relative distance for making avoidance behavior thereof that is smaller than that of a large ship 11. Hence, in a case where a ship 11 for extracting a case where avoidance behavior thereof is made is small, the first extraction unit 41 may have a predetermined range that is smaller than that of a case where a ship 11 for extracting a case where avoidance behavior thereof is made is large. For example, in a case where a ship 11 for extracting a case where avoidance behavior thereof is made is small, a predetermined range is 50 [m] and is not limited thereto. For example, in a case where a ship 11 for extracting a case where avoidance behavior thereof is made is large, a predetermined range is 200 [m] and is not limited thereto. The first extraction unit 41 determines a size of a ship 11 based on, for example, information such as a length or a width of the ship 11 that is included in the AIS accumulation data 30, and accordingly, sets such a predetermined range.

Although a case where a first predetermined period of time and a second predetermined period of time for extracting particular ship track data are different times on a front and a back of point data with a relative distance therebetween being within a predetermined range has been described as an example in the embodiment as described above, a disclosed device is not limited thereto. For example, a first predetermined period of time and a second predetermined period of time for extracting particular ship track data may be identical times on a front and a back of point data with a relative distance therebetween being within a predetermined range. For example, the first extraction unit 41 may extract, as ship track data, point data at a first predetermined period of time before that of point data with a relative distance therebetween being within a predetermined range to point data at the first predetermined period of time (second predetermined period of time) after that of the point data with a relative distance therebetween being within a predetermined range.

Although a case where data are created that connect point data of a ship 11A and point data of a ship 11B with a line segment at a point of time when a ship 11 previously arrives at a local minimum point has been described as an example in the embodiment as described above, a disclosed device is not limited thereto. For example, it is sufficient for the rendering unit 43 to create data in such a manner that a line segment that connects point data of a ship 11A and point data of a ship 11B at a point of time when a ship 11 previously arrives at a local minimum point is distinguishable from another line that connects point data at an identical point of time. That is, it is sufficient for the rendering unit 43 to create data that enhances a practical position of a ship 11 at a local minimum point as compared with another position. Thereby, a practical position of a ship 11 at a local minimum point is emphatically displayed on the display unit 23 as compared with another position.

Figure 11:
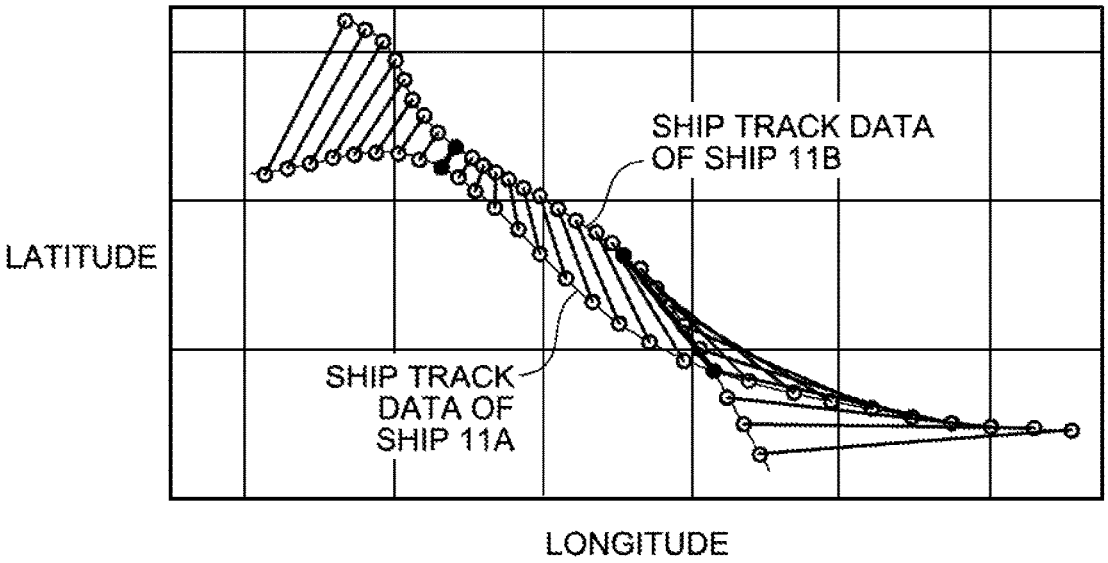
FIG. 11 is a diagram illustrating an example of an image with enhanced practical positions of ships at a local minimum point.

FIG. 11 is a diagram illustrating an example of an image with an enhanced practical position of a ship 11 at a local minimum point. FIG. 11 illustrates, for each point of time, a line segment that connects point data of a ship 11A and point data of a ship 11B at an identical point of time. For example, the rendering unit 43 creates a line segment that connects point data of the ship 11A and point data of the ship 11B at a point of time when a ship 11 previously arrives at a local minimum point so as to be thicker than another line segment. For example, the rendering unit 43 creates data in such a manner that colors of point data of the ship 11A and point data of the ship 11B at a point of time when a ship 11 previously arrives at a local minimum point are colors that are different from a color of another point data.

The rendering unit 43 may create data in such a manner that a color of a line segment that connects point data of the ship 11A and point data of the ship 11B at a point of time when a ship 11 previously arrives at a local minimum point is a color that is different from a color of another line segment. That is, the rendering unit 43 may create data that displays a line segment that connects point data of the ship 11A and point data of the ship 11B at a point of time when a ship 11 previously arrives at a local minimum point, so as to be highlighted with respect to another line segment.

Thereby, the ship track data display device 20 can emphatically display a place where it is estimated that ships 11 cause abnormal closeness therebetween or make avoidance behavior thereof, and a risk of collision therebetween is high, even in a case where, for example, positions of ships 11 at an identical point of time are connected with respective line segments.

Although a case where a distance between point data of the ship 11A and each of point data of the ship 11B is calculated has been described as an example in the embodiment as described above, a disclosed device is not limited thereto. For example, the second extraction unit 42 selects point data Ai of the ship 11A at a point of time ti that are included in particular ship track data. The second extraction unit 42 extracts point data Bj that exist in a vicinity of the point data Ai from point data Bj of the ship 11B. For example, the second extraction unit 42 calculates a distance between the point data Ai and each of the point data Bj of the ship 11B from latitude and longitude of the point data Ai and latitude and longitude of each of the point data Bj of the ship 11B. The second extraction unit 42 extracts point data Bj with a distance between the point data being less than or equal to a predetermined distance, as the point data Bj that exist in a vicinity of the point data Ai. A predetermined distance is, for example, 500 [m], and is not limited thereto. A predetermined distance may be changeable externally. For example, the display unit 23 may be caused to display a screen for setting a predetermined range that is changeable by input from the input unit 22. The second extraction unit 42 calculates a distance between the point data Ai of the ship 11A and the extracted point data Bj of the ship 11B, and accordingly, extracts a local minimum point.

For example, the second extraction unit 42 may calculate a difference between latitude of the point data Ai and latitude of each of the point data Bj of the ship 11B. For example, the second extraction unit 42 may calculate a difference between longitude of the point data Ai and longitude of each of the point data Bj of the ship 11B. The second extraction unit 42 may extract point data with at least one of the calculated differences being less than or equal to a predetermined difference, as point data Bj in a vicinity thereof. A predetermined difference is a difference with a distance between ships is a predetermined distance, that is, for example, a difference with a distance between ships being 500 [m] and is not limited thereto. A predetermined difference may be changeable externally. For example, the display unit 23 may be caused to display a screen for setting a predetermined range that is changeable by input from the input unit 22.

That is, the second extraction unit 42 may extract, as a local minimum point, a place where a distance between ship tracks is less than or equal to a predetermined distance and the distance between ship tracks is at a local minimum. Thereby, the ship track data display device 20 can reduce an amount of data for calculating a distance between ship tracks as a local minimum point is extracted, and can reduce a load thereon.

Figure 12:
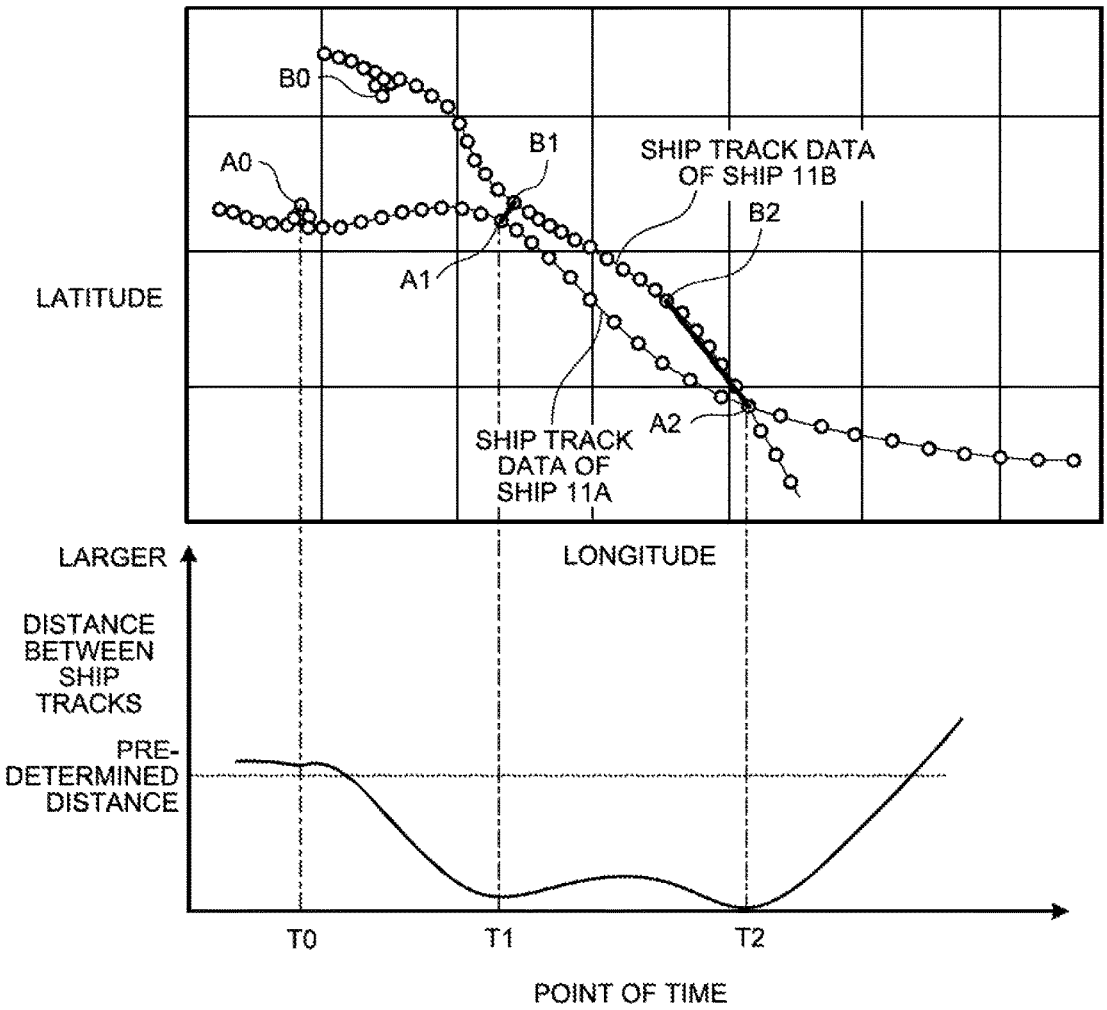
FIG. 12 is a diagram illustrating an example of an image that indicates practical positions of ships at a local minimum point and a distance between ship tracks thereof.

FIG. 12 is a diagram illustrating an example of an image that indicates practical positions of ships 11 at a local minimum point and a distance between ship tracks thereof. FIG. 12 illustrates a case where a distance between ship tracks is at a local minimum at a point of time T0 in the particular ship track data as illustrated in FIG. 5. In FIG. 12, a line segment is not drawn that connects point data A0 of a ship 11A and point data B0 of a ship 11B at the point of time T0.

At the point of time T0, a distance between ship tracks is larger than a predetermined distance at a place where the distance between ship tracks is at a local minimum. Hence, a place where a distance between ship tracks is at a local minimum at the point of time T0 is not extracted as a local minimum point, and a line segment that connects the point data A0 of the ship 11A and the point data B0 of the ship 11B at the point of time T0 is not drawn. It is considered that the ship 11A and the ship 11B do not make avoidance behavior thereof at a place where a distance between ship tracks thereof is at a local minimum, at the point of time T0, and the distance between ship tracks is at the local minimum due to special behavior of the ships. Special behavior of ships is, for example, a course change for departure from a harbor. The ship track data display device 20 eliminates, from local minimum points, a place where a ship 11 does not make avoidance behavior thereof although a distance between ship tracks is at a local minimum. Thereby, the ship track data display device 20 can emphatically display a place where a ship 11 has a high possibility of making avoidance behavior thereof.

For example, the second extraction unit 42 may extract, as a local minimum point, a place where an amount of a change of a distance between ship tracks from a third predetermined period of time before a point of time when the distance between ship tracks is at a local minimum to the point of time when the distance between ship tracks is at a local minimum is greater than a predetermined amount of a change and the distance between ship tracks is at the local minimum, from particular ship track data. For example, the second extraction unit 42 may extract, as a local minimum point, a place where an amount of a change of a distance between ship tracks from a point of time when the distance between ship tracks is at a local minimum to a fourth predetermined period of time thereafter is greater than a predetermined amount of a change and the distance between ship tracks is at the local minimum, from particular ship track data. A third predetermined period of time is, for example, 10 seconds and is not limited thereto. A fourth predetermined period of time is, for example, 10 seconds and is not limited thereto. A third predetermined period of time and a fourth predetermined period of time may be different periods of time. A predetermined amount of a change is, for example, 50 [m] and is not limited thereto. A third predetermined period of time, a fourth predetermined period of time, and a predetermined amount of a change are periods of time and an amount of a change such that it is possible to determine that a ship 11 does not make special behavior of the ship but makes avoidance behavior thereof.

An amount of a change of a distance between ship tracks being greater than a predetermined amount of a change includes, for example, an amount of a change of a distance between ship tracks per unit time from a third predetermined period of time before a point of time when the distance between ship tracks is at a local minimum to the point of time when the distance between ship tracks is at a local minimum being greater than a first predetermined amount of a change. That is, the second extraction unit 42 may extract a local minimum point based on a total amount of a change of a distance between ship tracks from a third predetermined period of time before a point of time when the distance between ship tracks is at a local minimum to the point of time when the distance between ship tracks is at a local minimum. The second extraction unit 42 may extract a local minimum point based on an amount of a change of a distance between ship tracks per unit time from a third predetermined period of time before a point of time when the distance between ship tracks is at a local minimum to the point of time when the distance between ship tracks is at a local minimum. A first predetermined amount of a change is, for example, 5 [m] and is not limited thereto. A first predetermined amount of a change is an amount of a change such that it is possible to determine that a ship 11 makes avoidance behavior thereof.

Similarly, an amount of a change of a distance between ship tracks being greater than a predetermined amount of a change includes, for example, an amount of a change of a distance between ship tracks per unit time from a point of time when the distance between ship tracks is at a local minimum to a fourth predetermined period of time thereafter being greater than a second predetermined amount of a change. A second predetermined amount of a change is, for example, 5 [m] and is not limited thereto. A first predetermined amount of a change and a second predetermined amount of a change may have different values.

In a case where ships 11 make special behavior of the ships as illustrated in FIG. 12, an amount of a change of a distance between the ships is small. Hence, the ship track data display device 20 eliminates, from local minimum points, a place where an amount of a change of a distance between ship tracks is less than or equal to a predetermined amount of a change even in a case the distance between ship tracks is at a local minimum. Thereby, the ship track data display device 20 can emphatically display a place where it is estimated that ships 11 cause abnormal closeness therebetween or make avoidance behavior thereof, and a risk of collision therebetween is high.

Each component of each device as illustrated in the drawings is functionally conceptual and need not be physically configured as illustrated in the drawings. That is, a specific state of separation or integration of respective devices is not limited to that illustrated in the drawings, and all or a part thereof can be configured to be functionally or physically separated or integrated in an arbitrary unit depending on a variety of loads, usage, or the like. For example, respective processing units that are the acquisition unit 40, the first extraction unit 41, the second extraction unit 42, the rendering unit 43, and the output unit 44 may be integrated or separated appropriately. All or any part of respective processing functions that are executed in each rendering unit 43 can be realized by a CPU and a program that is analyzed and executed in the CPU or realized by hardware based on a wired logic.

Ship Track Data Display Program

Figure 13:
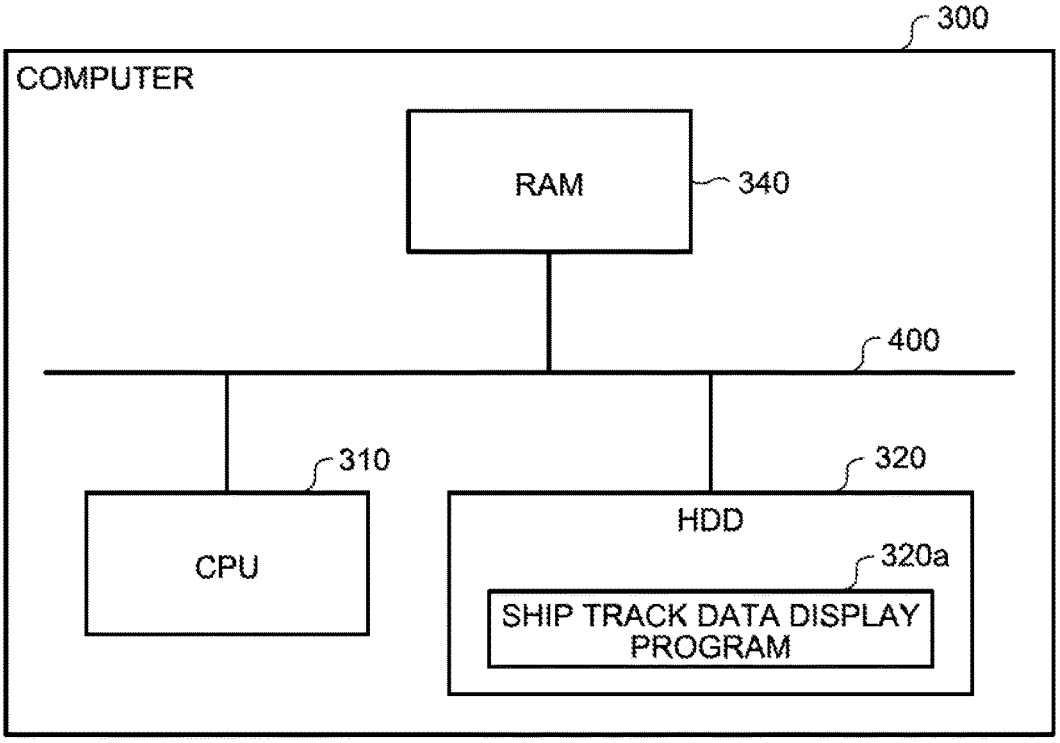
FIG. 13 is a diagram illustrating a computer that executes a ship track data display program.

A variety of processes as described in the embodiment as described above can also be realized by executing a preliminarily prepared program in a computer system such as a personal computer or a workstation. Hereinafter, an example of a computer system will be described that executes a program that has a function similar to that of the embodiment as described above. FIG. 13 is a diagram illustrating a computer that executes a ship track data display program 320*a*.

As illustrated in FIG. 13, a computer 300 includes a CPU 310, a Hard Disk Drive (HDD) 320, and a Random Access Memory (RAM) 340. Respective units 310 to 340 are connected to one another through a bus 400.

The ship track data display program 320*a* that fulfills a function similar to that of each rendering unit 43 in the embodiment as described above is preliminarily stored in the HDD 320. For example, the ship track data display program 320*a* is stored that fulfills functions similar to those of the acquisition unit 40, the first extraction unit 41, the second extraction unit 42, the rendering unit 43, and the output unit 44 in the embodiment as described above. The ship track data display program 320*a* may be divided appropriately.

The HDD 320 stores a variety of data. For example, the HDD 320 stores an OS and a variety of data.

The CPU 310 reads from the HDD 320 and executes the ship track data display program 320*a*, and thereby, executes an operation similar to that of each rendering unit 43 in the embodiment. That is, the ship track data display program 320*a* executes operations similar to those of the acquisition unit 40, the first extraction unit 41, the second extraction unit 42, the rendering unit 43, and the output unit 44 in the embodiment.

The ship track data display program 320*a* as described above need not be stored in the HDD 320 from a start. For example, a program is stored in a "portable physical medium" that is inserted into the computer 300, such as a flexible disk (FD), a Compact Disk Read Only Memory (CD-ROM), a Digital Versatile Disk (DVD), a magneto optical disk, or an IC card. The computer 300 may read therefrom and execute a program.

A program is stored in "another computer (or server)" or the like that is connected to the computer 300 through a public line, the internet, a LAN, a WAN, or the like. The computer 300 may read therefrom and execute a program.

According to an embodiment of the present invention, an advantageous effect is provided such that a case where a ship makes avoidance behavior thereof can readily be extracted.

All examples and conditional language recited herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A non-transitory computer-readable recording medium storing a ship track data display program that causes a computer to execute a process comprising:

first extracting particular ship track data for a set of particular ships with a relative distance therebetween being within a predetermined range, from ship track data for a plurality of ships;

second extracting a place where a distance between ship tracks thereof is at a local minimum, from the particular ship track data; and associatively displaying, for the place, point data of a ship that previously arrives at the place, in the set of particular ships, and point data of another ship at a point of time when the ship that previously arrives at the place arrives at the place, wherein the displaying includes providing information that is able to readily be determined as to whether a risky case where the particular ships make avoidance behavior thereof is provided, by causing a display to display an image with the point data of the ship and the point data of the another ship being associatively connected with a line segment, at a local minimum point.

2. The non-transitory computer-readable recording medium according to claim 1, wherein the displaying includes drawing a line segment that connects the point data of a ship that previously arrives at the place and the point data of the another ship at a point of time when the ship that previously arrives at the place arrives at the place.

3. The non-transitory computer-readable recording medium according to claim 2, wherein the displaying includes displaying the line segment to be distinguishable from another line that connects point data of ships at an identical point of time.

4. The non-transitory computer-readable recording medium according to claim 1, wherein the first extracting includes extracting, as the particular ship track data, point data at a first predetermined period of time before time of point data with the relative distance being within the predetermined range to point data at a second predetermined period of time after time of the point data with the relative distance being within the predetermined range.

5. The non-transitory computer-readable recording medium according to claim 1, wherein the second extracting includes extracting a place where the distance between ship tracks is less than or equal to a predetermined distance and the distance between ship tracks is at a local minimum.

6. The non-transitory computer-readable recording medium according to claim 1, wherein the second extracting includes extracting a place where an amount of a change of the distance between ship tracks from a third predetermined period of time before a point of time when the distance between ship tracks is at a local minimum to the point of time when the distance between ship tracks is at a local minimum is greater than a predetermined amount of a change, or an amount of a change of the distance between ship tracks from a point of time when the distance between ship tracks is at a local minimum to a fourth predetermined period of time thereafter is greater than the predetermined amount of a change, and the distance between ship tracks is at a local minimum.

7. A ship track data display method comprising:

first extracting particular ship track data for a set of particular ships with a distance between ship tracks thereof being less than a predetermined distance, from ship track data for a plurality of ships, by a processor;

second extracting a place where the distance between ship tracks is at a local minimum, from the particular ship track data, by the processor; and associatively displaying, for the place, point data of a ship that previously arrives at the place, in the set of particular ships, and point data of another ship at a point of time when the ship that previously arrives at the place arrives at the place, wherein the displaying includes providing information that is able to readily be determined as to whether a risky case where the particular ships make avoidance behavior thereof is provided, by causing a display to display an image with the point data of the ship and the point data of the another ship being associatively connected with a line segment, at a local minimum point.

8. A ship track data display device comprising:

a processor configured to:

extract particular ship track data for a set of particular ships with a distance between ship tracks thereof being less than a predetermined distance, from ship track data for a plurality of ships;

extract a place where the distance between ship tracks is at a local minimum, from the particular ship track data; and associatively display, for the place, point data of a ship that previously arrives at the place, in the set of particular ships, and point data of another ship at a point of time when the ship that previously arrives at the place arrives thereat, wherein the displaying includes providing information that is able to readily be determined as to whether a risky case where the particular ships make avoidance behavior thereof is provided, by causing a display to display an image with the point data of the ship and the point data of the another ship being associatively connected with a line segment, at a local minimum point.

* * * * *